US007775021B2

(12) United States Patent
Lin

(10) Patent No.: US 7,775,021 B2
(45) Date of Patent: Aug. 17, 2010

(54) ANTENNA PACKAGING METHOD

(75) Inventor: Hung-Yuan Lin, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 56 days.

(21) Appl. No.: 12/274,788

(22) Filed: Nov. 20, 2008

(65) Prior Publication Data

US 2009/0223170 A1 Sep. 10, 2009

(30) Foreign Application Priority Data

Mar. 6, 2008 (TW) ..... 97107859 A

(51) Int. Cl.
*B65B 5/06* (2006.01)
*B65B 23/00* (2006.01)
*B65D 81/113* (2006.01)

(52) U.S. Cl. ..... 53/445; 53/447; 53/449; 53/472; 206/521

(58) Field of Classification Search ..... 53/445, 53/447, 449, 472, 155, 540, 238; 206/320, 206/448, 500, 521, 585, 587
See application file for complete search history.

(56) References Cited

U.S. PATENT DOCUMENTS 3,414,121 A * 12/1968 Suzuki ..... 206/320
4,166,531 A * 9/1979 Fujiwara ..... 206/320
4,640,419 A * 2/1987 Yang ..... 206/320
4,653,646 A * 3/1987 Allen et al. ..... 206/579
4,710,777 A * 12/1987 Halverson ..... 343/840
4,934,126 A * 6/1990 Wiegand et al. ..... 53/472
4,953,698 A * 9/1990 Gregorich et al. ..... 206/320
5,011,011 A * 4/1991 Kidd ..... 206/587
5,240,378 A * 8/1993 Janisse et al. ..... 206/320
5,685,431 A * 11/1997 Chambers et al. ..... 53/472

FOREIGN PATENT DOCUMENTS

FR 2723567 A1 * 2/1996
JP 52052786 A * 4/1977 ..... 53/472
JP 02205578 A * 8/1990 ..... 206/320
JP 07291384 A * 11/1995
JP 08058875 A * 3/1996
JP 09030587 A * 2/1997
JP 09077048 A * 3/1997
JP 09077049 A * 3/1997
JP 09240774 A * 9/1997
JP 10081371 A * 3/1998
JP 10139035 A * 5/1998
JP 11165784 A * 6/1999

* cited by examiner

*Primary Examiner*—Stephen F Gerrity
(74) *Attorney, Agent, or Firm*—Quintero Law Office

(57) ABSTRACT

An antenna packaging method is provided. First, a first dish, a second dish, a third dish, a first bracket, a second bracket, a third bracket, a first arm, a second arm and a third arm are provided, wherein each of the first, second and third dishes has a central area. Then, a packaging unit is provided. Next, the first dish, the second dish and the third dish overlap with other. Then, the packaging unit is fixed to the first dish, the second dish and the third dish. Next, the first arm, the second arm and the third arm are fixed to the packaging unit. Finally, the first bracket, the second bracket and the third bracket are fixed to the packaging unit, wherein the first bracket, the second bracket and the third bracket correspond to the central area.

12 Claims, 7 Drawing Sheets

ANTENNA PACKAGING METHOD

CROSS REFERENCE TO RELATED APPLICATIONS

This Application claims priority of Taiwan Patent Application No. 097107859, filed on Mar. 6, 2008, the entirety of which is incorporated by reference herein.

BACKGROUND OF THE INVENTION

1. Field of the Invention

The present invention relates to an antenna packaging method, and in particular relates to an antenna packaging method utilizing a package with decreased size.

2. Description of the Related Art

FIG. 1*a* shows a conventional antenna package disclosed in the People's Republic of China Patent NO. CN 2801697Y, wherein a plurality of packaging blocks 10 is provided, the packaging blocks 10 overlap with each other, and elements of the antenna are separately packaged by the packaging blocks 10. Conventionally, the packaging blocks 10 are thick, and the elements of the antenna are arranged disorderly. Therefore, the size of the antenna package is large.

With reference to FIG. 1*b*, conventionally, a down converter 20 and a dish (not shown) are packaged in a same antenna package. However, the shape of the down converter 20 cannot match the shape of the dish. Thus, packaging the down converter and the dish in different layers is required, and size of the antenna package is further increased.

BRIEF SUMMARY OF THE INVENTION

A detailed description is given in the following embodiments with reference to the accompanying drawings.

An antenna packaging method is provided. First, a first dish, a second dish, a third dish, a first bracket, a second bracket, a third bracket, a first arm, a second arm and a third arm are provided, wherein each of the first, second and third dishes has a central area. Then, a packaging unit is provided. Next, the first dish, the second dish and the third dish are overlapped with other. Then, the packaging unit is fixed to the first dish, the second dish and the third dish. Next, the first arm, the second arm and the third arm are fixed to the packaging unit. Finally, the first bracket, the second bracket and the third bracket are fixed to the packaging unit, wherein the first bracket, the second bracket and the third bracket correspond to the central area.

In the embodiment of the invention, the first bracket, the second bracket and the third bracket are disposed corresponding to the concave surface. Thus, the size of the antenna package is relatively reduced. Additionally, the antenna package of the embodiment utilizes a single-layered packaging unit to receive and fix the dishes, and separately packages the arms and the brackets of the antenna, down converters and dishes, thus, more efficiently utilizing receiving space when compared to conventional methods.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
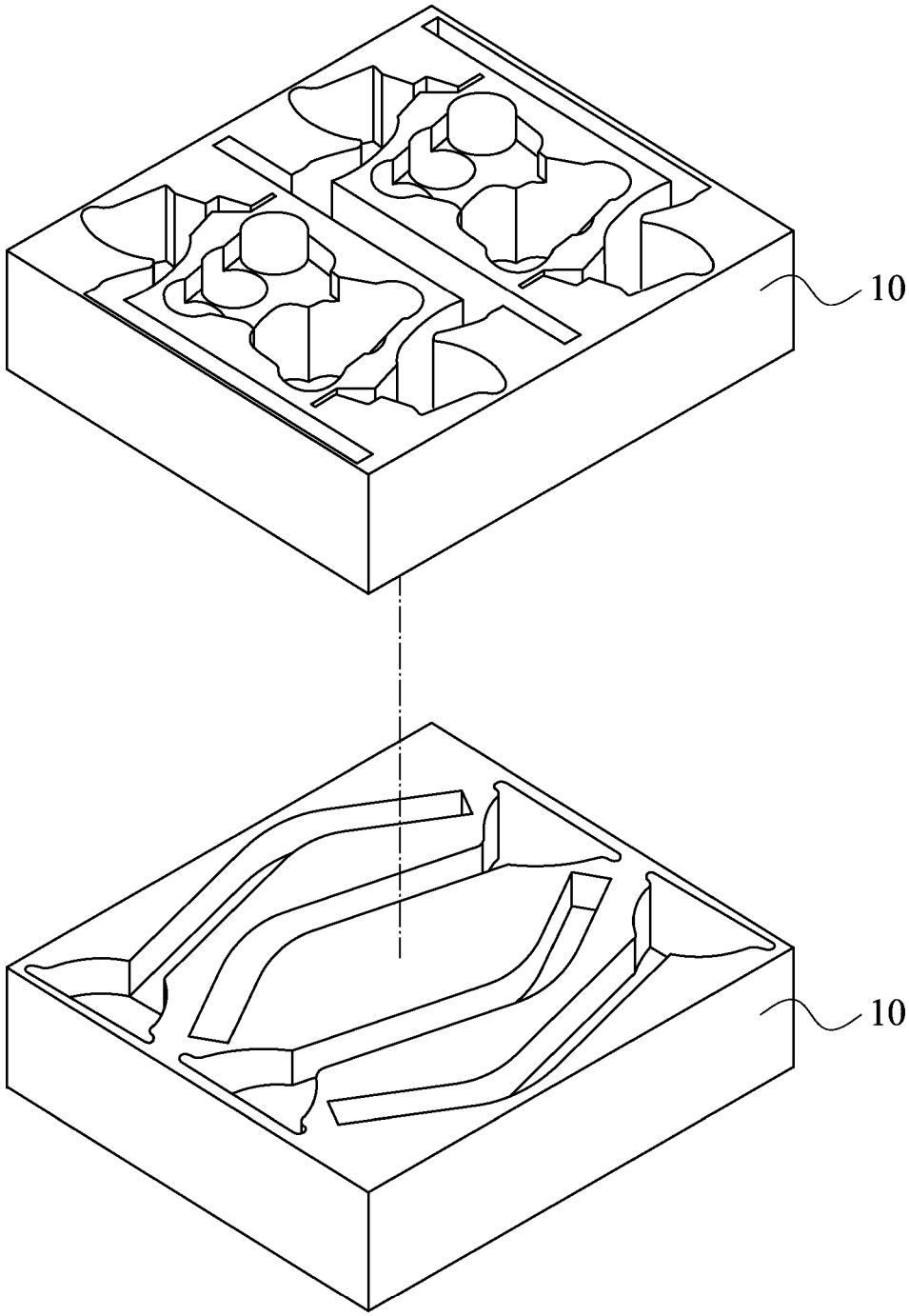
FIG. 1a (PRIOR ART)
FIGS. 1*a* and 1*b* show a conventional antenna packaging method disclosed in the People's Republic of China Patent NO. CN 2801697Y.
Figure 1B:
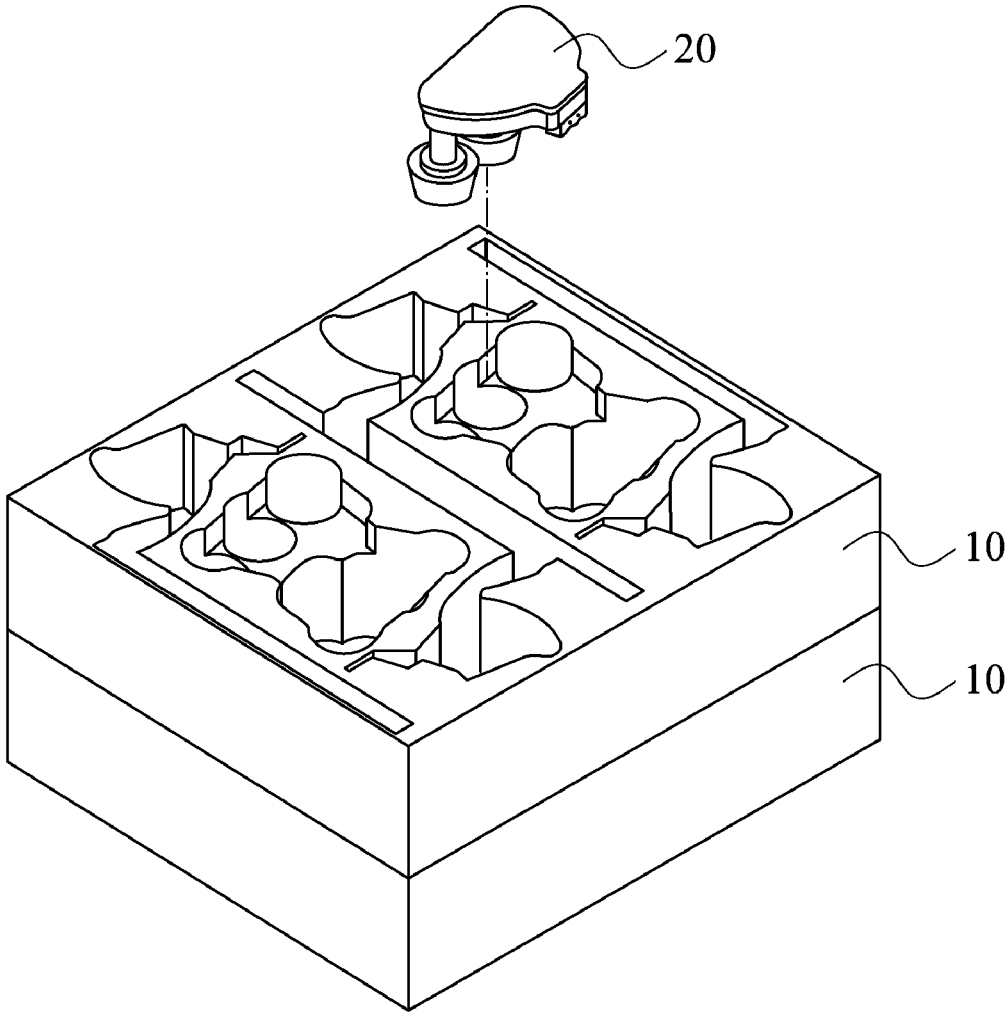
FIG. 1b (PRIOR ART)
Figure 2:
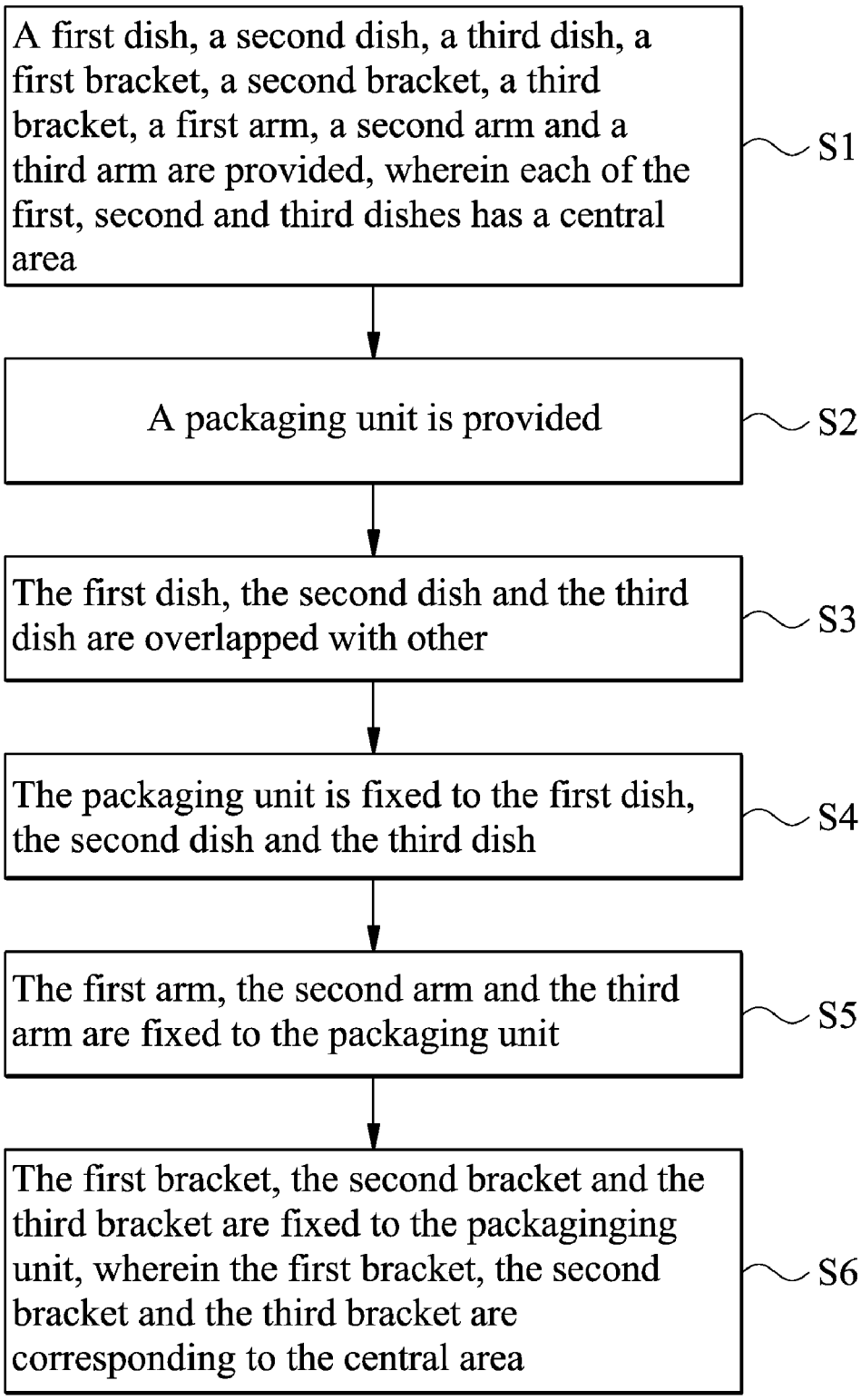
FIG. 2 shows an antenna packaging method of an embodiment of the invention.

FIG. 2 shows an antenna packaging method of an embodiment of the invention. First, a first dish, a second dish, a third dish, a first bracket, a second bracket, a third bracket, a first arm, a second arm and a third arm are provided, wherein each of the first, second and third dishes has a central area (S1). Then, a packaging unit is provided (S2). Next, the first dish, the second dish and the third dish are overlapped with other (S3). Then, the packaging unit is fixed to the first dish, the second dish and the third dish (S4). Next, the first arm, the second arm and the third arm are fixed to the packaging unit (S5). Finally, the first bracket, the second bracket and the third bracket are fixed to the packaging unit, wherein the first bracket, the second bracket and the third bracket correspond to the central area (S6).

Figure 3:
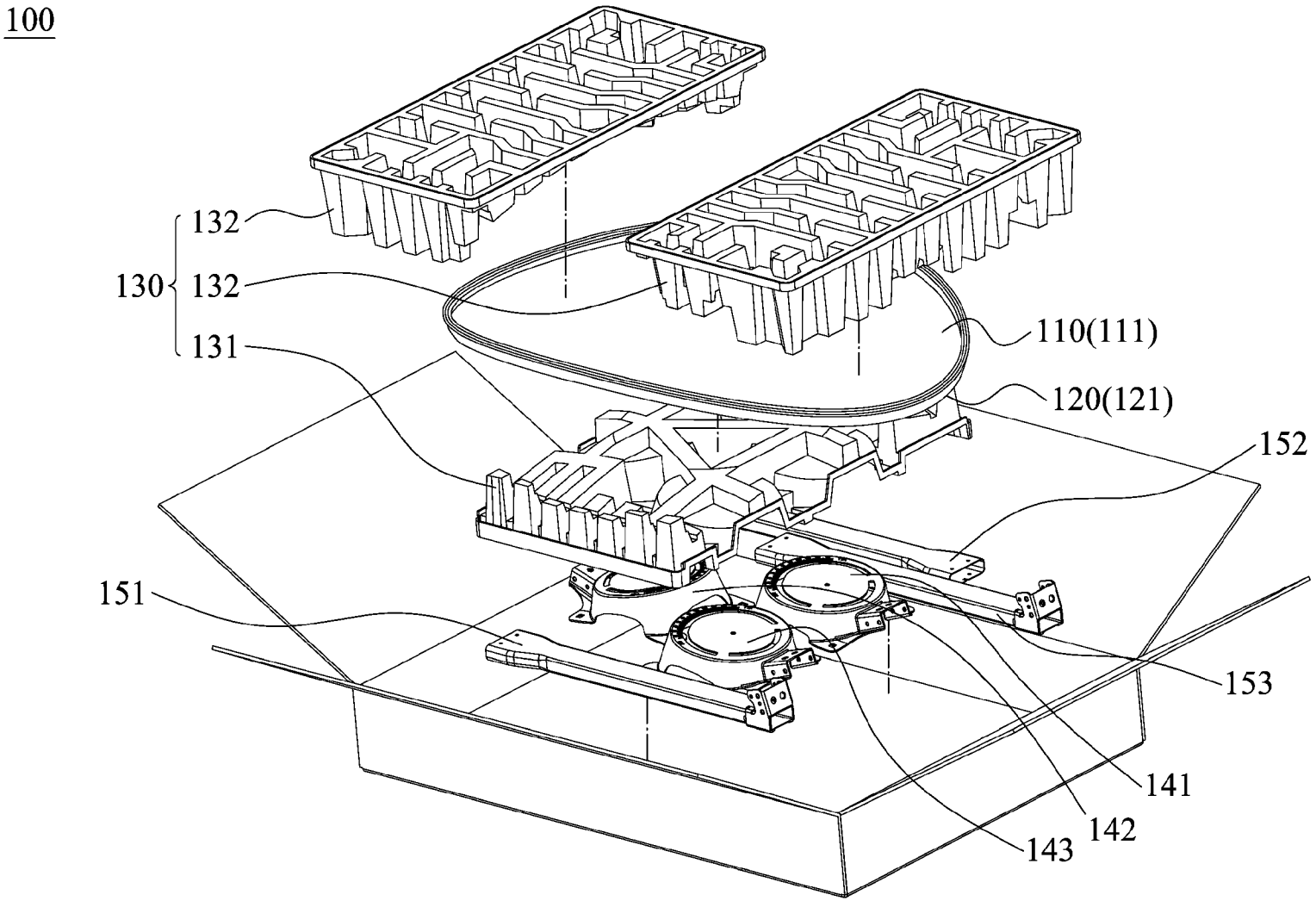
FIG. 3 is an exploded view of an antenna package of an embodiment of the invention.

FIG. 3 is an exploded view of an antenna package 100 of the embodiment. The first dish 110, the second dish 120 and the third dish are overlapped with each other. The third dish is sandwiched between the first dish 110 and the second dish 120. The first dish 110 has a convex surface 111. The second dish 120 has a concave surface 121. The first dish 110 the second dish 110 and the third dish are fixed to the packaging unit 130. The packaging unit 130 comprises a first packaging block 131 and two second packaging blocks 132. The first packaging block 131 contacts the concave surface 121. The first bracket 141, the second bracket 142 and the third bracket 143 are fixed to the first packaging bracket 131, and the second packaging blocks 132 are fixed to the convex surface 111. The first arm 151, the second arm 152 and the third arm 153 are fixed to the first packaging block 131 and the second packaging blocks 132.

Figure 4:
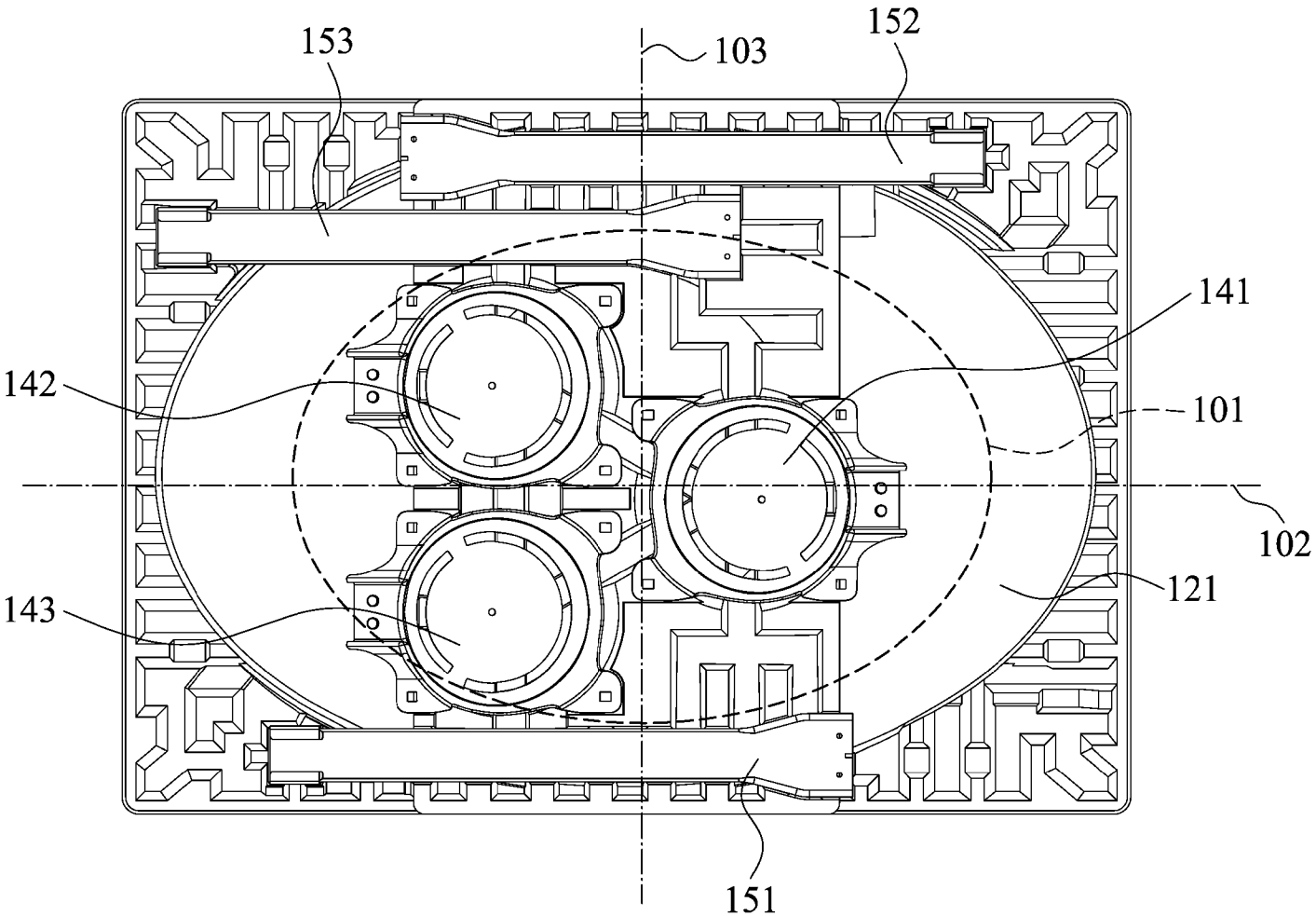
FIG. 4 is a top view of the antenna package of the embodiment of FIG. 3.

FIG. 4 is a top view of the antenna package 100 of the invention. Each of the first, second and third dish has a central area 101 a major axis 102 and a minor axis 103. The major axis 102 is perpendicular to the minor axis 103. The first bracket 141, the second bracket 1442 and the third bracket 1443 correspond to the central area 101. The area of the central area 101 is substantially equal to one-third the area of the first, second or third dish. The first arm 151, the second arm 152, and the third arm 153 are parallel to the major axis 102 and correspond to the concave surface 121. The first bracket 141, the second bracket 142 and the third bracket 143, correspond to and face the concave surface 121.

Figure 5:
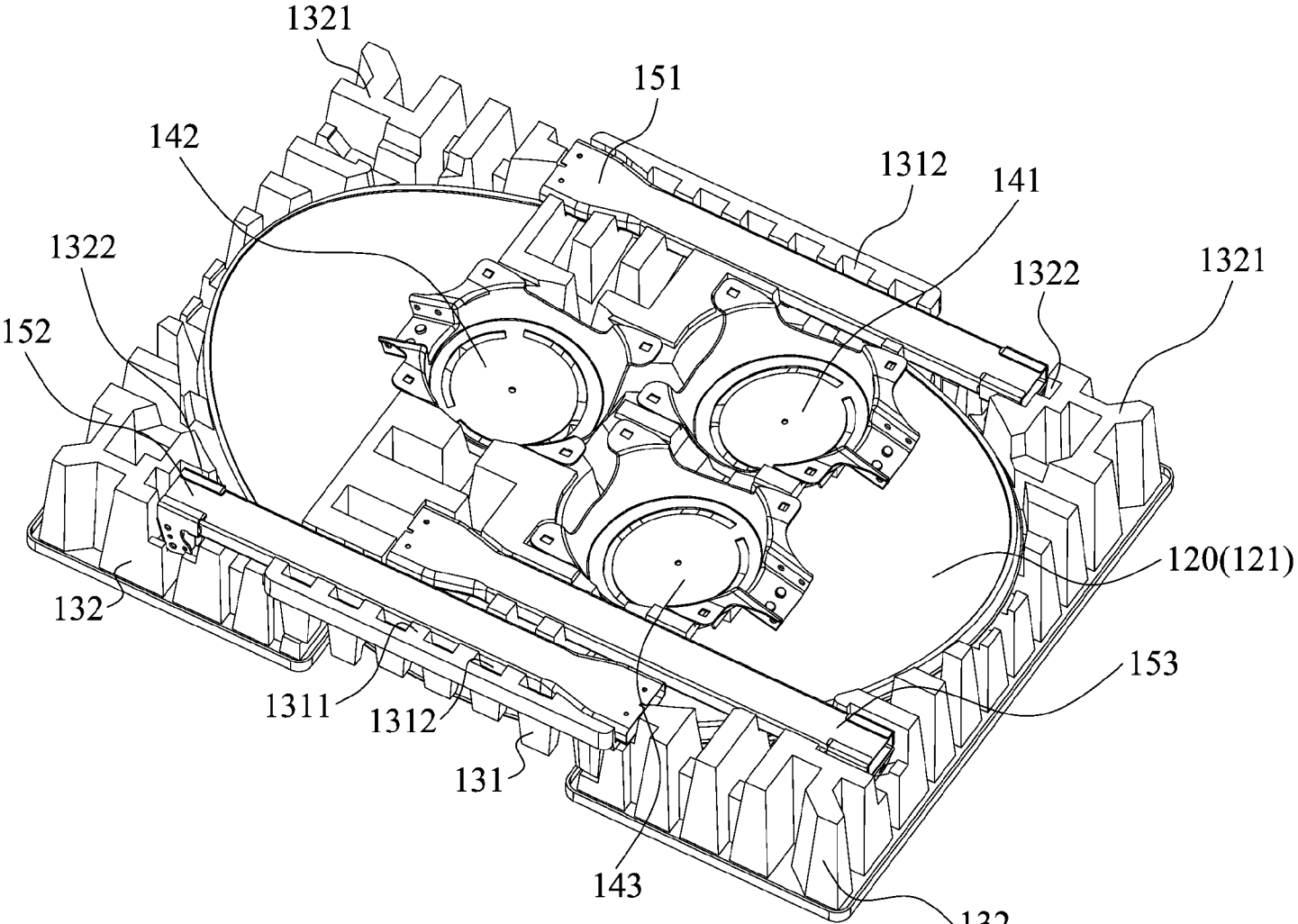
FIG. 5 shows an assembled antenna package of the embodiment of FIG. 3.

FIG. 5 shows an assembled antenna package 100. The first packaging block 131 comprises a first surface 1311. Each of the second packaging blocks 132 comprises a second surface 1321. When the first dish 110, the second dish 120, the third dish, the first bracket 141, the second bracket 142, the third bracket 143, the first arm 151, the second arm 152 and the third arm 153 are fixed to the first packaging block 131, the second packaging blocks 132, the first surface 1311 and the second surface 1321 are on the same plane. A plurality of first grooves 1312 is formed on the first surface 1311. A plurality of second grooves 1322 is formed on the second surfaces 1321. The first grooves 1312 correspond to the second grooves 1322. The first arm 151, the second arm 152 and the third arm 153 are received in the first groove 1312 and the second grooves 1322.

In the embodiment of the invention, the first bracket 141, the second bracket 142 and the third bracket 143 are disposed corresponding to the concave surface 121. Thus, the size of the antenna package is relatively reduced. Additionally, the antenna package of the embodiment utilizes a single-layered packaging unit to receive and fix the dishes, and separately packages the arms and the brackets of the antenna, down converters and dishes, thus, more efficiently utilizing receiving space when compared to conventional methods.

Figure 6:
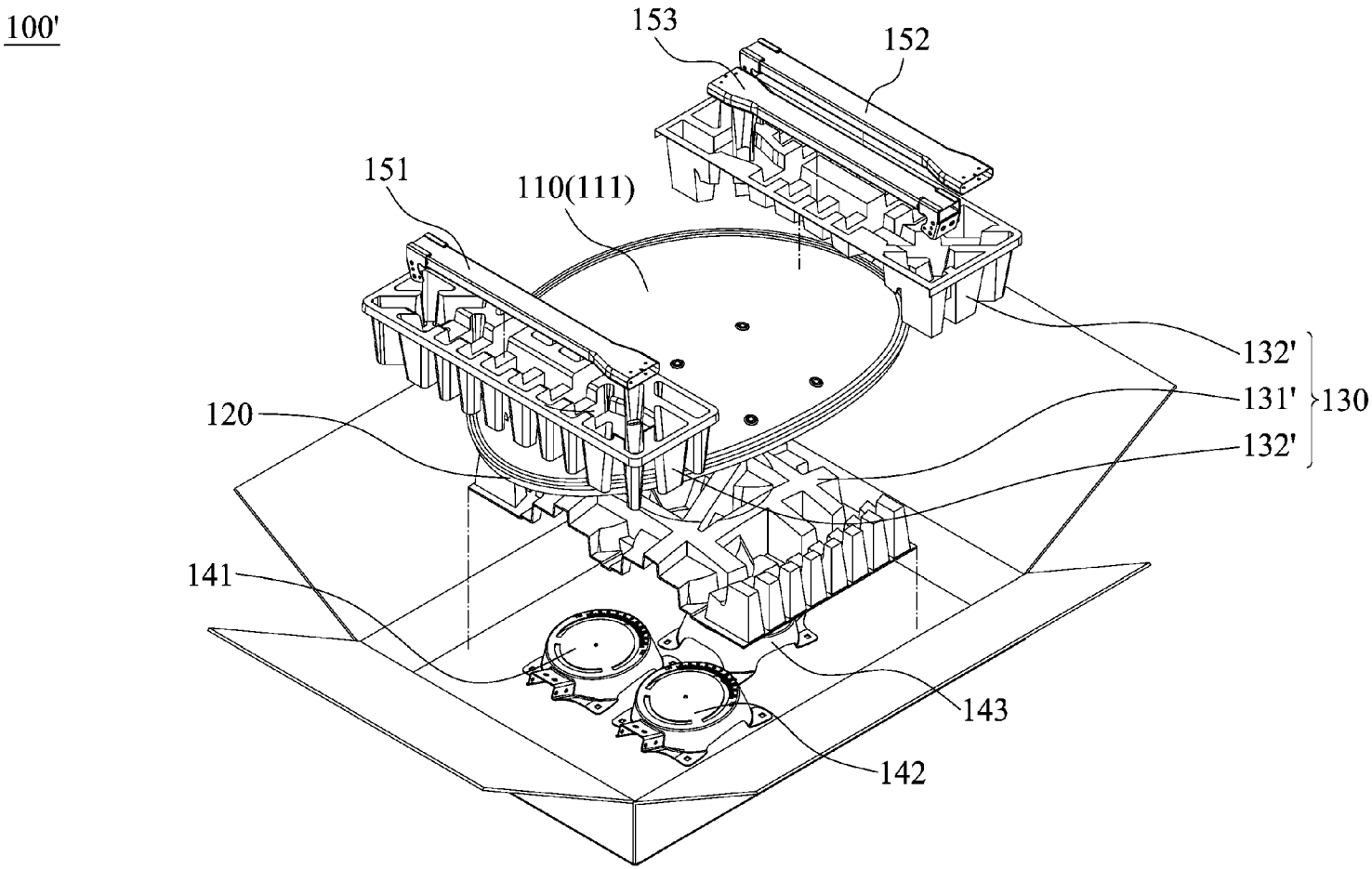
FIG. 6 shows an antenna package of a modified embodiment of the invention.

FIG. 6 shows an antenna package 100' of a modified embodiment of the invention. In the modified embodiment, a first packaging block 131' contacts the concave surface. The first bracket 141, the second bracket 142 and the third bracket 143 are fixed to the first packaging block 131'. Second packaging blocks 132' are fixed to the convex surface 111. The first arm 151, the second arm 152 and the third arm 153 are fixed to the second packaging blocks 132. The first arm 151, the second arm 152 and the third arm 153 face the convex surface 111, and correspond to edges of the dishes. The first bracket 141, the second bracket 142 and the third bracket 143, correspond to and face the concave surface. In the modified embodiment, the first arm 151, the second arm 152 and the third arm 153 are parallel to the minor axis.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna packaging method, comprising:

providing a first dish, a second dish, a first bracket, a second bracket, a first arm and a second arm, wherein each of the first and second dishes has a central area, the first dish has a convex surface, and the second dish has a concave surface;

providing a packaging unit;

overlapping the first dish and the second dish;

fixing the packaging unit to the first dish and the second dish;

fixing the first arm and the second arm to the packaging unit; and fixing the first bracket and the second bracket to the packaging unit, wherein the first bracket and the second bracket correspond to the central area, the packaging unit comprises a first packaging block and two second packaging blocks, the first packaging block contacts the concave surface of the second dish, the first bracket and the second bracket are fixed to the first packaging block, the second packaging blocks contact the convex surface of the first dish, and the first arm and the second arm are fixed to the second packaging blocks.

2. The antenna packaging method as claimed in claim 1, wherein the first arm and the second arm correspond to edges of the first and second dishes.

3. The antenna packaging method as claimed in claim 1, wherein an area of the central area substantially equals to one-third an area of the first or second dish.

4. The antenna packaging method as claimed in claim 1, wherein each of the first and second dishes has a major axis and a minor axis, and the major axis is perpendicular to the minor axis.

5. The antenna packaging method as claimed in claim 4, wherein the first arm and the second arm are parallel to the major axis.

6. The antenna packaging method as claimed in claim 4, wherein the first arm and the second arm are parallel to the minor axis.

7. The antenna packaging method as claimed in claim 1, wherein the first arm and the second arm are facing the convex surface of the first dish, and the first bracket and the second bracket are facing the concave surface of the second dish.

8. The antenna packaging method as claimed in claim 1, wherein each of the first and second dishes has a major axis and a minor axis, the major axis is perpendicular to the minor axis, and the first arm and the second arm are parallel to the minor axis.

9. An antenna packaging method, comprising:

providing a first dish, a second dish, a first bracket, a second bracket, a first arm and a second arm, wherein each of the first and second dishes has a central area, the first dish has a convex surface, and the second dish has a concave surface;

providing a packaging unit;

overlapping the first dish and the second dish;

fixing the packaging unit to the first dish and the second dish;

fixing the first arm and the second arm to the packaging unit; and fixing the first bracket and the second bracket to the packaging unit, wherein the first bracket and the second bracket correspond to the central area, the packaging unit comprises a first packaging block and two second packaging blocks, the first packaging block contacts the concave surface of the second dish, the first bracket and the second bracket are fixed to the first packaging block, the second packaging blocks contact the convex surface of the first dish, and the first arm and the second arm are fixed to the first packaging block and the second packaging blocks.

10. The antenna packaging method as claimed in claim 9, wherein the first arm and the second arm are facing the concave surface of the second dish, and the first bracket and the second bracket are facing the concave surface of the second dish.

11. The antenna packaging method as claimed in claim 9, wherein each of the first and second dishes has a major axis and a minor axis, the major axis is perpendicular to the minor axis, and the first arm and the second arm are parallel to the minor axis.

12. The antenna packaging method as claimed in claim 9, wherein the first packaging block has a first surface, and each of the second packaging block has a second surface, and when the first dish, the second dish, the first bracket, the second bracket, the first arm and the second arm are fixed to the first and second blocks, the first surface and the second surface are on a same plane, and a plurality of first grooves is formed on the first surface, a plurality of second grooves is formed on the second surface, the first grooves correspond to the second grooves, and the first arm and the second arm are received in the first groove and the second groove.

* * * * *